United States Patent [19]

Sartorio

[11] Patent Number: 4,706,491

[45] Date of Patent: Nov. 17, 1987

[54] PROCESS AND APPARATUS FOR PRECISION FOLDING OF SHEET METAL

[75] Inventor: Franco Sartorio, Turin, Italy

[73] Assignee: Prima Industrie, S.p.A., Turin, Italy

[21] Appl. No.: 880,704

[22] Filed: Jul. 1, 1986

[30] Foreign Application Priority Data

Jul. 15, 1985 [IT] Italy ..... 67647 A/85

[51] Int. Cl.[4] ..... B21D 11/22

[52] U.S. Cl. ..... 72/461; 72/9; 72/12; 72/14; 901/6; 901/46; 493/18

[58] Field of Search ..... 72/461, 24, 8, 9, 12, 72/14, 17, 389; 493/15, 18, 13, 19, 20, 417; 901/1, 13, 6, 45, 46, 47; 269/10; 83/467 R

[56] References Cited

U.S. PATENT DOCUMENTS

| | | | |
|---|---|---|---|
| 3,553,990 | 1/1971 | Suding et al. | 72/14 |
| 4,155,243 | 5/1979 | Elsner | 901/46 |
| 4,192,168 | 3/1980 | Di Ciaccio | 72/461 |
| 4,357,821 | 11/1982 | Fowler | 72/461 |
| 4,366,423 | 12/1982 | Inaba et al. | 901/6 |
| 4,372,721 | 2/1983 | Harjar et al. | 414/730 |
| 4,668,157 | 5/1987 | Kato et al. | 901/46 |

FOREIGN PATENT DOCUMENTS

| | | | |
|---|---|---|---|
| 75761 | 6/1977 | Japan | 901/6 |
| 667362 | 6/1979 | U.S.S.R. | 901/46 |

*Primary Examiner*—Robert L. Spruill
*Assistant Examiner*—David B. Jones
*Attorney, Agent, or Firm*—Omri M. Behr

[57] ABSTRACT

A process is described which makes use of a folding press and a numerically controlled manipulator device provided with mechanical pincers; the sheet metal to be worked is gripped by the manipulator device and carried against an abutment shoulder disposed in front of the press; the alignment of the front edge of the sheet metal with the abutment shoulder is then tested by means of microswitches, and then the sheet metal is carried under the blade of the folding press utilizing, as reference co-ordinates for the movements of the manipulator, those of the abutment shoulder.

10 Claims, 5 Drawing Figures

PROCESS AND APPARATUS FOR PRECISION FOLDING OF SHEET METAL

BACKGROUND OF THE INVENTION

The present invention relates to a process for precision folding metal sheet in a completely automatic manner. The present invention further relates to a folding installation for performing this process.

It is known that the precision folding of sheet metal is normally effected by means of particularly equipped folding presses served by operators who manually manipulate the sheet metal to be folded. The precision positioning of the sheet metal to be folded is obtained by bringing this up against movable reference abutments which are controlled by a numerical control which positions them from time to time in an appropriate manner. Such numerically controlled movable references, known with the technical name "back gauges" become substantially redundant if manipulation of the sheet metal in an automatic manner by means of robots is effected; in fact, the robots are themselves the numerically controlled devices; these, however, have the necessary positioning precision only for relatively small movements and therefore it is not currently possible, if it is desired to obtain high working precision, to do away with the auxiliary positioning devices and rely for correct positioning of the sheet metal solely on the manipulator robots. On the other hand the use of "back gauges" modified in a manner such as to adapt them to operate together with a robotised manipulator would involve the provision of automatic folding installations of high cost by way of the duplication of the numerically controlled devices (one for the movable references and one for the robots).

SUMMARY OF THE INVENTION

The object of the invention is that of providing a process for effecting the precision folding of sheet metal in an automatic manner by utilising a folding press of the known type and a numerically controlled robotised manipulator device. A further object of the invention is that of providing an automatic sheet metal folding system of relatively low cost and high precision.

The said objects are achieved by the invention in that it relates to a process for automatically effecting the precision folding of sheet metal by means of a numerically controlled robotised manipulator device and a folding press, characterized by the fact that it comprises the following stages:

- gripping a metal sheet by the said manipulator device;
- positioning the said metal sheet, by means of the said manipulator device, against a fixed abutment shoulder disposed in front of the said folding press parallel to a blade thereof and at a known and relatively small distance from the said blade;
- testing the alignment of a front edge of the said metal sheet with the said abutment shoulder and possible correction of the position of the said metal sheet by actuation of the said manipulator device; and
- displacement of the said metal sheet into the folding position under the blade by means of the said manipulator device, utilising the coordinates of the said abutment shoulder as the reference coordinates.

The invention further relates to a system for effecting automatic folding of sheet metal comprising at least one folding press and at least one robotised numerically controlled manipulator device operable to grip and selectively position the said metal sheets, one at a time, in a plurality of predetermined positions in which the said metal sheets are to be worked by the said folding press, characterised by the fact that it includes an abutment device disposed frontally in front of the said folding press and connected to a central control unit of the said manipulator device, the said abutment device comprising at least one abutment shoulder disposed parallel to a blade of the said folding press and at a predetermined and relatively small distance therefrom, and a plurality of pairs of end-of-path switches carried by the said shoulder and selectively actuable by the said central control unit, the said pairs of switches having their switches disposed at different mutual distances.

BRIEF DESCRIPTION OF THE DRAWINGS

The invention will now be described in a non-limitative manner with reference to the attached drawings, in which.

DETAILED DESCRIPTION OF THE INVENTION

Figure 1:
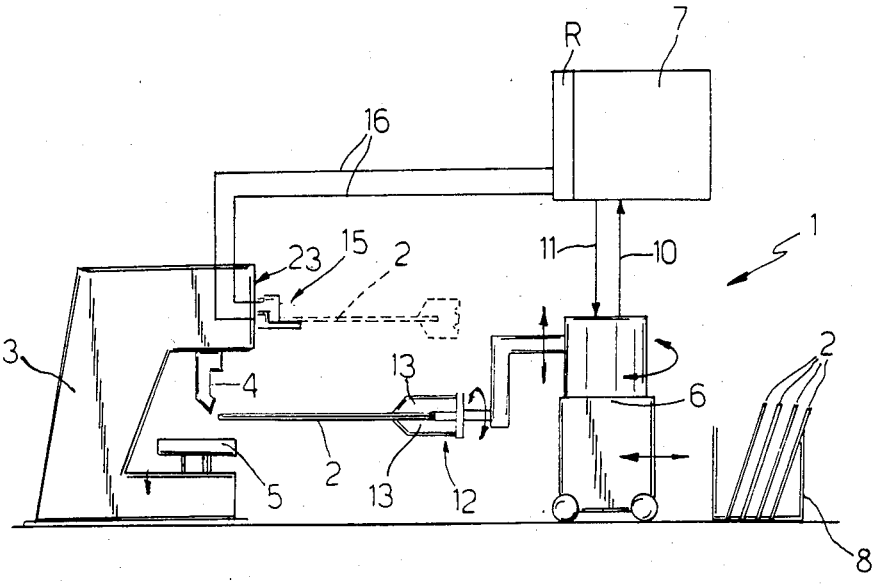
FIG. 1 schematically illustrates a side view of a folding system formed according to the invention.
Figure 3:
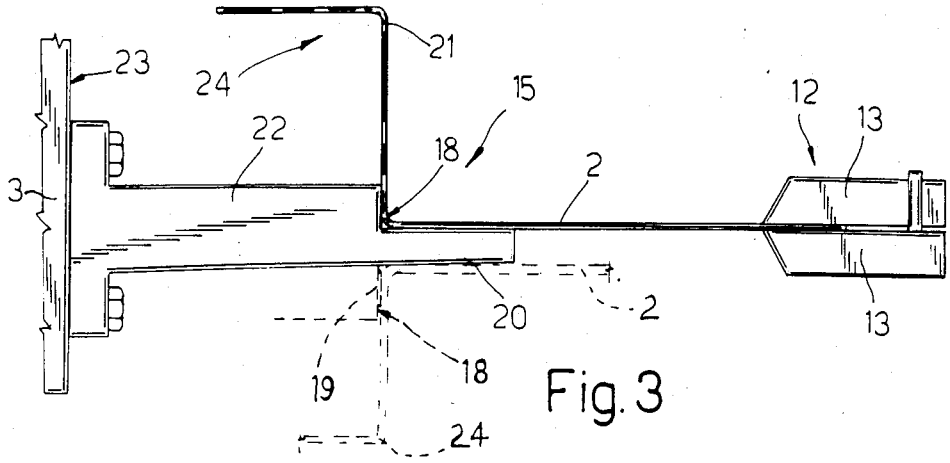
FIGS. 3 and 4 illustrate, on an enlarged scale, a detail of the system of FIG. 1.
Figure 4:
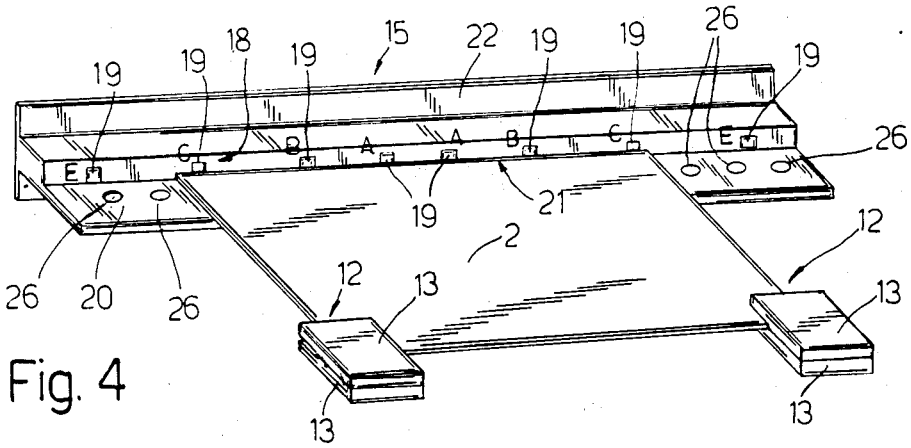

With reference to FIGS. 1, 3 and 4, there is generally indicated with the reference numeral 1 a system for the precision folding of sheet metal 2 of different dimensions; the system 1 includes a folding press 3 of known type comprising in turn a fixed blade 4 and a vertically movable anvil or matrix 5, a robotised numerically controlled manipulator device 6, and a central control unit 7 for the device 6; the device 6 is of known type and is able to grip the metal sheets 2, taking them from a movable magazine or "pallet" 8 and selectively position them, one at a time, for displacement along three Cartesian axes to a plurality of pre-determined different positions in which the metal sheets 2 are to be worked by the press 3; these positions are memorised in the central control unit 7 which is also of known type, for example of the micro-processor type, or else are calculated by the central control unit 7 on the basis of suitable parameters introduced into it by an operator; the central control unit 7 is connected to the device 6 by means of respective control lines 10 and 11 and comprises a register 7 in which are memorised the reference coordinates on the basis of which the central control unit 7 determines the displacements which the gripper members of the device 6 have to perform; these, according to the invention, are preferably constituted by a pair of mechanical pincers 12 (FIG. 4) each of which includes a pair of counterposed jaws 13 of a form able to grip the metal sheet 2 on at least two adjacent sides, the opening and closure of which can be controlled separately for each pincer 12 by the central control unit 7.

According to the invention, the system 1 further includes an abutment device 15 disposed in front of the folder 3 and connected to the central control unit 7 by means of suitable signal lines 16; the device 15 includes at least one fixed abutment shoulder 18 disposed parallel to the blade 4 at a predetermined known distance D therefrom (FIG. 2) and a plurality of pairs of end of stroke switches 19 of known type, for example constituted by microswitches or by proximity switches rigidly fixed onto the shoulder 18 and selectively and separatedly activatable by the central control unit 7 in dependence on the dimensions of the metal sheet 2 being worked. The distance D between the shoulder 18 and the axis of the blade 4 must, according to the invention, be relatively small with respect to the size of the displacement to which the sheet metal 2 is subjected in the working thereof and, for example, can be of the order of several tenths of a centimeter, and the microswitches 19 of the shoulder 18 are preferably all disposed adjacent one another at the same height; the pairs of microswitches 19, indicated with the different letters of the alphabet in FIG. 4, each have their microswitches 19 disposed at mutually different distances, equidistant on opposite sides of the mid-line of the shoulder 18 and each is connected in a known way, not illustrated for simplicity, with the lines 16; preferably, the device 15 further includes a reference bracket 20 for a front edge 21 of the metal sheet 2 being worked, this bracket facing the folder 3, and an attachment element 22 rigidly connecting the shoulder 18 and the bracket 20 and fixed at the front of the folder 3 against a frontal surface 23 thereof immediately above the blade 4. The element 22 is disposed to project from the surface 23 in such a way as to maintain the shoulder 18 spaced from a surface 23 itself by a predetermined distance such as to allow the free displacement of the metal sheet 2 during folding, for example sufficient to receive a previously folded portion 24 (FIG. 3) of the edge 21, and the bracket 20 is disposed perpendicularly projecting in front of the shoulder 18 and immediately beneath it in such a way as to be able to support and guide the metal sheet 2.

In a possible variant, illustrated in broken outline in FIG. 3, the device 15 can include a further shoulder 18 disposed immediately beneath the bracket 20 and with its edge aligned with the upper shoulder 18, provided, as this latter, with pairs of end-of-stroke switches 19 in such a way that the edge 21 of an already partly folded sheet 2 can be carried against such supplementary shoulder 18 if the folded portion 24 is turned downwardly. Moreover, to allow the lateral alignment of the metal sheet 2 to be folded (FIG. 4) the bracket 20 can be provided in correspondence with the shoulder or shoulders 18 with a plurality of photocells 26 or other equivalent sensor devices connected in a known way not illustrated with the central control unit 7 through the lines 16 so as to be able to indicate to this latter the position of the lateral edges of the metal sheet 2 being worked.

Figure 2:
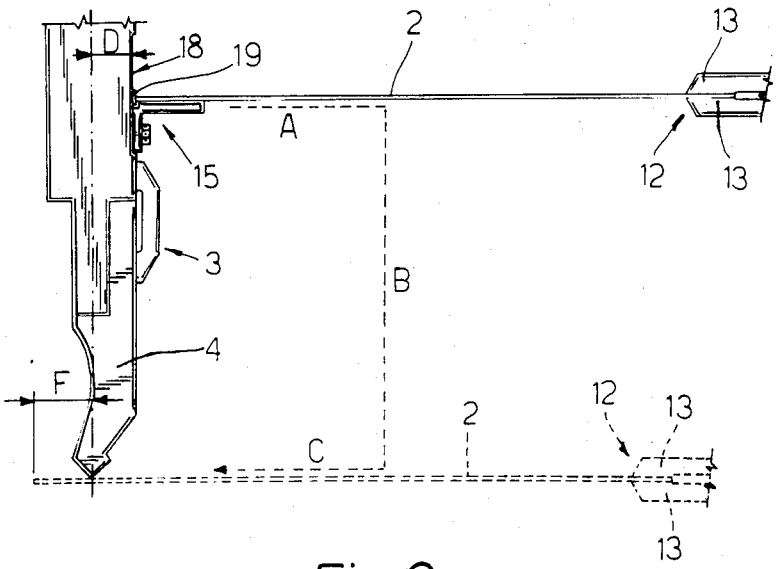
FIGS. 2 and 5 illustrate different stages of the folding process according to the invention.
Figure 5:
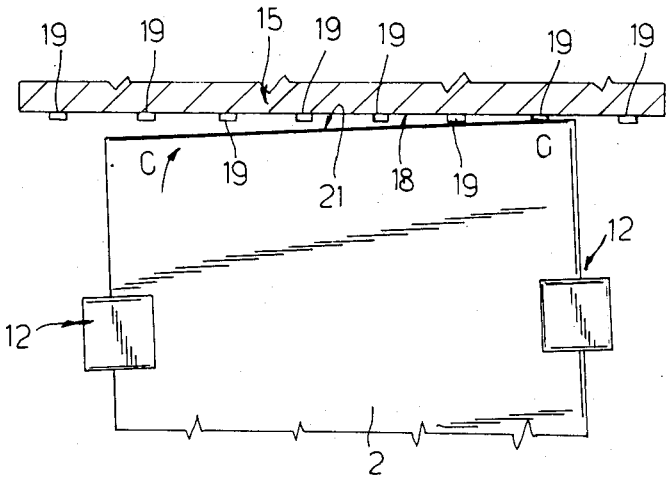

Making reference now to FIGS. 2 and 5, the programme memorised in the central control unit 7 causes the automatic manipulation by the pincers 12 of each metal sheet 2 to be folded, by means of a succession of operations comprising, in each case, at least four fundamental stages, that is to say:

- gripping of a metal sheet 2 from the magazine 8 by the pincers 12;
- positioning of the metal sheet 2 against the shoulder 18 by actuation of the manipulator device 6 guided by the central control unit 7;
- testing of the alignment of the edge 21 with the shoulder 18, effected by means of the microswitches 19, and possible correction of the position of the metal sheet 2 by further actuation of the device 6;
- displacement of the metal sheet 2 into the folding position under the blade 4 by means of the manipulator 6, utilising as reference coordinates those of the shoulder 18 which are known, this being fixed, in place of the reference coordinates previously used to grip the metal sheet 2 and position it against the shoulder 18 itself.

In particular, in dependence on the reference coordinates memorised in the register R and the other information memorised therein, the central control unit 7 guides the device 6 first towards the magazine 8 and then, having taken up a metal sheet 2 and disposed this horizontally, towards the folder 3 and in particular towards the device 15; because of the limits of precision of the device 6 over large distances (several metres) the metal sheet 2 does not become correctly positioned on the device 15 by the central control unit 7 solely on the basis of its knowledge of the coordinates of this latter, and therefore the central control unit 7 uses the microswitches 19 in the following manner: one of the pairs of microswitches 19, for example the pair indicated C, is activated by the central control unit 7, whilst the other microswitches are left disactivated, the pair to be activated being chosen on the basis of the dimensions of the metal sheet 2 to be worked in such a way that the distance between the two microswitches 19 of the activated pair is substantially equal to or less than the width of the sheet 2 which is being positioned; then the central control unit 7 positions the pincers 12 in such a way as to lay the metal sheet 2 onto the bracket 20 and then cause the pincers 12 to advance towards the shoulder 18; since the metal sheet 2 is normally out of alignment, further advancement of the edge 21 will cause it to come into contact with only one of the end-of-stroke switches 19 of the pair of microswitches C (FIG. 5) causing a signal to be sent to the central control unit 7 through the lines 16; in dependence on the signal received the central control unit 7 controls the opening of the jaws 13 of the pincer 12 which is on the side of the activated microswitch 19 pressed by the edge 21 and causes further advancement of the pincers 12. In this way the metal sheet 2, which is maintained by a single pincer 12, can turn in consequence of the advancement of the pincers 12 with a fulcrum on the microswitch pressed by the edge 21 until the other microswitch 19 of the pair C is also reached by the edge 21. When the central control unit 7 detects that both the microswitches 19 of the pair C are pressed it signifies that the edge 21 is correctly aligned with the abutment 18 and therefore the pincers 12 are stopped (FIG. 2) and the register R is reset by introducing therein a nul value or else the value of the coordinates of the shoulder 18 in dependence on the operating philosophy of the central control unit 7. The resetting of the register R informs the central control unit 7 that the edge 21 is correctly aligned with the blade 4 and at the known relatively small distance therefrom equal to the distance D between the blade 4 and the shoulder 18 which has been previously memorised in the control unit 7; at this point, therefore, the control unit 7 commands the device 6 in such a way as to make the metal sheet 2 perform the movement indicated in broken outline in FIG. 2 obtaining the positioning of the edge 21 under the blade 4 in the folding position, at a distance F behind the blade 4 itself, a distance which is certainly equal to the correct distance set by the programme in that in the displacement of the metal sheet 2 by the device 15 under the blade 4 the manipulator 6 performs movements of relatively small amplitude given the proximity between the shoulder 18 and the blade 4 and therefore this permits the positioning of the edge 21 with a satisfactory degree of precision. In the case in which the manipulator 6 is provided with a single pincer 12 (for example in the case of systems intended to work metal sheets of small dimensions), it is necessary that it be provided with a numerically controlled axis in addition to that required in the more general case first described; in particular, it is necessary that the single pincer 12 can turn parallel to the plane in which it lies under the control of the central control unit 7; in this case, in fact, when the misaligned edge 21 touches one of the microswitches 19 of the activated pair producing the emission of a signal to the central control unit 7, this can cause the pincer 12 to turn towards the side at which the pressed switch is located until the other microswitch of the activated pair is reached by the edge 21 itself. At this point the edge 21, similar, to what has been described above, is aligned and the rotation of the pincer 12 can therefore be stopped and the register R reset.

Finally, when it is also necessary to align the metal sheet laterally with precision, for example in the case of the construction of boxes by folding, the central control unit 7 makes use of the optical sensors 26 as follows; by means of the manipulator 6 and after having aligned the edge 21, the metal sheet 2 is made to translate parallel to the abutment shoulder 18 until one of its lateral edges reaches one of the sensors 26 causing a signal to be sent to the central control unit 7; this, now, interrupts the lateral translation movement and resets a register similar to the register R and in which are contained the reference coordinates for the lateral movements assuming, as new reference coordinates, the known rigorously exact coordinates of the sensor 26 activated because of the lateral movement of the metal sheet 2. At this point, the spatial position of the metal sheet 2 being known with precision, and this being located already in close proximity to the blade 4, it is possible for the central control unit, as previously described, to displace the metal sheet 2 under the blade 4 into the folding position with sufficient precision by means of the manipulator 6 alone.

From what has been described the advantages connected with the invention will be apparent; the expensive "back guage" devices are replaced by the abutment device 15 which, being simply constituted by common end-of-stroke sensors mounted on a fixed abutment is of insignificant cost. Notwithstanding this the device 15 permits the metal sheet being worked to be positioned with high precision in close proximity to the folding press against the abutment 18 and, thanks to the sufficient precision obtainable with the known numerically controlled manipulator devices of any type (for small displacements) consequently to position the metal sheet under the tool of the folder with sufficient precision in that this is located in proximity to the abutment 18. The folding operation can thus be completely automated without giving up the working precision and with low system costs.

I claim:

1. A process for effecting automatic precision folding of metal sheets by means of a robotised numerically controlled manipulator device (6) and a folding press (3), characterised by the fact that it comprises the following steps:

gripping of a metal sheet (2) by the said manipulator device (6);

positioning the said metal sheet (2), by means of the said manipulator device (6) against a fixed abutment shoulder (18) positioned in front of the said folding press (3) parallel to a blade (4) thereof and at a known and relatively small distance from the said blade (4);

checking the alignment of a front edge (21) of the said metal sheet (2) with the said abutment shoulder (18) and possible correction of the position of the said metal sheet (2) by means of actuation of the said manipulator device (6); and displacement of the said metal sheet (2) into the folding position under the said blade (4) by means of the said manipulator device (6) utilising, as reference coordinates, the coordinates of the said abutment shoulder (18).

2. A process according to claim 1, characterised by the fact that the said checking phase is performed by activating a pair of end-of-stroke switches (19) mounted on the said abutment shoulder (18) at a separation substantially equal to or less than the width of the said metal sheet (2), and bringing the said front edge (21) of the metal sheet (2) against the said end-of-stroke switches (19).

3. A process according to claim 2 in which a manipulator device (6) is used comprising a pair of mechanical gripping pincers (12) for the said metal sheet (2), characterised by the fact that the said correction of the position of the said metal sheet (2) is obtained by opening the jaws (13) of the pincer (12) of the said manipulator device (6) which is located on the side of the first switch (19) of the said pair of end-of-stroke switches (19) with which the said front edge (21) of the metal sheet (2) comes into contact and continuing to move the said pincers (12) towards the said abutment shoulder (18) until both the said end-of-stroke switches (19) are pressed by the said front edge (21).

4. A process according to claim 2, in which a manipulator device (6) comprising a single mechanical gripping pincer (12) for the said metal sheet (2) is used, characterised by the fact that the said correction of the position of the said metal sheet (2) is obtained by making the said pincer (12) of the said manipulator device (6) turn towards the side where the first switch (19) of the said pair of end of stroke switches (19) with which the said front edge (21) of the metal sheet (2) comes into contact is located, and continuing to turn the said pincer (12) until both the said end-of-stroke switches (19) are pressed by the said front edge (21).

5. A system for effecting the automatic folding of metal sheets (2) comprising at least one folding press (3) and at least one robotised numerically controlled manipulator device (6) operable to grip and selectively position the said metal sheets (2) one at a time in a plurality of predetermined positions in which the said metal sheets are to be worked by the said folding press (3), characterised by the fact that is includes an abutment device (15) disposed frontally in advance of the said folding press (3) and connected to a central control unit (7) of the said manipulator device (6), the said abutment device (15) including at least one abutment shoulder (18) disposed parallel to a blade (4) of the said folding press (3), at a predetermined relatively small distance therefrom, and a plurality of pairs of end-of-stroke switches 19 carried by the said shoulder (18) and selectively activatable by the said central control unit (7), the said switches of said pairs (19) being disposed at different separations from one another.

6. A system according to claim 5, characterised by the fact that the said abutment device (15) further includes a reference bracket (20) for a front edge (21) of the said metal sheets (2), disposed perpendicularly projecting in front of the said abutment shoulder (18), and an attachment element (22) fixed to the front of the said folding press (3) immediately above the said blade (4) and rigidly carrying the said abutment shoulder (18) and the said reference bracket (20), the said attachment element (22) being projectingly disposed with respect to a frontal surface (23) of the said folding press (3) in such a way as to maintain the said abutment shoulder (18) at a predetermined distance from the said surface (23) such as to allow the free displacement of the said metal sheet (2) during folding.

7. A system according to claim 6, characterised by the fact the said end-of-stroke switches (19) are disposed on the said abutment shoulder (18) or adjacent one another and at the same height, and by the fact that the said abutment device (15) includes two fixed abutment shoulders (18) provided with the said end-of-stroke switches (19) disposed aligned with one another respectively above and below the said reference bracket (20).

8. A system according to claim 5, characterised by the fact the said robotised manipulator device (6) includes a pair of mechanical pincers (12) having separately controllable counterposed jaws (13).

9. A system according to claim 5, characterised by the fact that the said robotised manipulator device (6) includes a single mechanical pincer (12) capable of rotating parallel to the plane in which it lies.

10. A system according to claim 6, characterised by the fact that the said abutment device (15) includes a plurality of optical sensors (26) disposed to the said central control unit (7).

* * * * *